US010104738B1

(12) United States Patent
Wang

(10) Patent No.: US 10,104,738 B1
(45) Date of Patent: Oct. 16, 2018

(54) FEEDBACK CIRCUIT CAPABLE OF REGULATING RESPONSE ACCORDING TO VARIATION OF DIMMING SIGNAL

(71) Applicant: MEANWELL (GUANGZHOU) ELECTRONICS CO., LTD, Guangzhou (CN)

(72) Inventor: Shih-Hsin Wang, New Taipei (TW)

(73) Assignee: MEANWELL (GUANGZHOU) ELECTRONICS CO., LTD. (CN)

( * ) Notice: Subject to any disclaimer, the term of this patent is extended or adjusted under 35 U.S.C. 154(b) by 0 days.

(21) Appl. No.: 15/806,392

(22) Filed: Nov. 8, 2017

(51) Int. Cl.
*H05B 33/00* (2006.01)
*H05B 33/08* (2006.01)

(52) U.S. Cl.
CPC ..... *H05B 33/0851* (2013.01); *H05B 33/089* (2013.01); *H05B 33/0827* (2013.01)

(58) Field of Classification Search
CPC ..... H05B 33/0893; H05B 37/03; H05B 33/0818; H05B 33/0854; H05B 33/0803; H05B 33/0851; H05B 33/0857; H05B 33/0866; H05B 33/0821; H05B 37/02
See application file for complete search history.

(56) References Cited

U.S. PATENT DOCUMENTS 8,569,956 B2 * 10/2013 Shteynberg ..... H05B 33/083 315/123
9,860,965 B2 * 1/2018 Recker ..... H05B 37/0272
9,877,361 B2 * 1/2018 Williams ..... A61N 5/06
9,913,642 B2 * 3/2018 Leimbach ..... A61B 17/072

* cited by examiner

*Primary Examiner* — Monica C King

(57) ABSTRACT

The present invention discloses a feedback circuit capable of regulating response according to variation of dimming signal, comprising an error amplifier unit, a bandwidth regulating unit and an optical coupler. This feedback circuit is applied in an LED illumination apparatus comprising a plurality of LED components, an LED driver, a PWM controller, and a dimming circuit unit. When the LED driver and the dimming circuit unit normally work, the bandwidth regulating unit produces an electrical resistance for regulating a feedback signal provided by the error amplifier unit according to a dimming signal of the dimming circuit unit. Therefore, the regulated feedback signal is outputted by the optical coupler for making the PWM controller correspondingly generates a controlling signal to adaptively regulate bandwidth of the LED driver, so as to attenuate an audible noise produced by the LED driver due to instability of the response.

10 Claims, 10 Drawing Sheets

FEEDBACK CIRCUIT CAPABLE OF REGULATING RESPONSE ACCORDING TO VARIATION OF DIMMING SIGNAL

BACKGROUND OF THE INVENTION

1. Field of the Invention

The present invention relates to the technology field of electronic circuits, and more particularly to a feedback circuit capable of regulating response according to variation of dimming signal.

2. Description of the Prior Art

Light-emitting diode, one kind of light radiating device, has been widely used for developing as various illumination apparatuses in human life because of having advantages of long service life and small size. When designing an LED illumination apparatus or system, it not only needs to well adopt a proper connection type for connecting a plurality of LED components acting as a load, but also to simultaneously chose a suitable LED driver for providing output a constant voltage/current to the load, such that the LED illumination apparatus can be ensured to work stably.

There are three connection types for connecting multi LED components, including serial connection type, parallel connection type and serial-parallel connection type. FIG. 1 shows a circuit framework diagram of a conventional LED illumination apparatus. From FIG. 1, it is found that a plurality of LED components are connected to each other in serial connection to form several LED strips 2', wherein the LED strips 2' are further connected to each other in parallel connection for acting as a load of an LED driver 1'. It is worth explaining that, when the LED driver 1' steadily provides an output voltage to the LED strips 2', corresponding values of driving currents passing through the LED components of each of the LED strips 2' would be the same because the driving voltages across over each of the LED strips 2' are identical. On the other hand, FIG. 1 also depicts that a feedback circuit unit 3' is connected to the output terminal of the LED driver 1' for monitoring and stabilizing the output voltage of the LED driver 1'.

Besides requirements of high luminance and energy conservation, people also demand that the LED illumination apparatus must be dimmable. As a result, LED driver manufacturers add a dimming circuit unit 4' and a dimming switch 41' into the circuit framework of the LED illumination apparatus as shown by FIG. 1. However, after the adding of the dimming circuit unit 4', it becomes more complicated and difficult for LED driver manufacturers to keep the stability of feedback response of the feedback circuit unit 3' during dynamic variations of the load. In other words, the dynamic response of the LED driver 1' controlled by the feedback circuit 3' unit is unable to fully follow up the dynamic variations of the load.

After the dimming circuit unit 4' outputs a dimming signal with a 50% duty cycle to the dimming switch 41', driving currents passing through the LED strips 2' immediately vary and then bring a corresponding load variation to the LED driver 1'. Moreover, from a Bode plot for describing the dynamic response of the LED driver shown in FIG. 2, it can find that the dynamic response of the LED driver 1' has a bandwidth (BW) of 1.2 KHz after a dynamic compensation is applied to the output voltage of the LED driver 1' by the feedback circuit unit 3'. In addition, it is worth noting that, the frequency response of the LED driver 1' exhibits −3 dB gain at 1.47 KHz, and that means the LED driver 1' would produce a noise with an audio frequency audible to the average human.

However, there is no approaches provided for solving the audible noise produced by the LED driver 1' due to the fact that a lot of noise exist in the environment of the LED driver 1'. On the other hand, since the fan noise produced by at least one heat dissipation fan of the LED driver 1' is louder than the audible noise, the audible noise is often ignored by users. It is worth noting that, LED driver 1' is used more and more widely, and that means the LED driver 1' may be applied in a quiet environment. In addition, it is unnecessary for a low-power LED driver to be equipped with heat dissipation fan. Based on above reasons, it is presumed that the audible noise produced by LED driver 1' will be got notices by users gradually.

From above descriptions, it is clear that there is no improvement approach or solution for effectively solving the audible noise of the LED driver 1' response in view of that, inventors of the present application have made great efforts to make inventive research thereon and eventually provided a feedback circuit capable of regulating response according to variation of dimming signal.

SUMMARY OF THE INVENTION

The primary objective of the present invention is to disclose a feedback circuit capable of regulating response according to variation of dimming signal Particularly, after the feedback circuit of the present invention is implemented into an LED driver, stability of the response of the LED driver is able to be well maintained while a dimming signal is inputted to the LED driver. By such arrangement, audible noise produced by the LED driver can be effectively attenuated. The feedback circuit of the present invention comprises an error amplifier unit, a bandwidth regulating unit and an optical coupler. When the LED driver and the dimming circuit unit normally work, the bandwidth regulating unit produces an electrical resistance for regulating a feedback signal provided by the error amplifier unit based on a dimming signal of the dimming circuit unit. Therefore, the regulated feedback signal is subsequently outputted by the optical coupler for making the PWM controller correspondingly generate a controlling signal to adaptively regulate bandwidth of the LED driver.

Inheriting to above descriptions, moreover, this novel feedback circuit can also adaptively maintain the stability of the response of the LED driver based on the variations of the output voltage of the LED driver as well as the dimming signal. More particularly, the feedback circuit is able to attenuate audible noise of produced by the LED driver due to the instability of the response through regulating bandwidth, gain margin and phase margin of the response of the LED driver.

For achieving the primary objective of the present invention, the inventor of the present invention provides an embodiment for the feed circuit, which is for use in an LED illumination apparatus comprising a plurality of LED components, an LED driver, a PWM controller, a dimming circuit unit, and a dimming switch, and able to regulate response of the LED driver according to the variation of a dimming signal generated by the dimming circuit unit. The feed circuit comprises:

an error amplifier unit, being electrically connected to output ends of the LED driver through at least one signal detection unit, used for generating a feedback signal based on an output signal of the LED driver;

a bandwidth regulating unit, being electrically connected to the error amplifier unit and the dimming circuit unit; and an optical coupler, being electrically connected to the bandwidth regulating unit;

wherein the bandwidth regulating unit is configured to produce an electrical resistance for regulating the feedback signal outputted from the error amplifier unit according to the dimming signal of the dimming circuit unit; moreover, the regulated feedback signal is further outputted by the optical coupler for making the PWM controller correspondingly generate a controlling signal to adaptively regulate bandwidth of the LED driver.

Moreover, in order to achieve the primary objective of the present invention, the inventor of the present invention provides another one embodiment for the control circuit, which is for use in an LED illumination apparatus comprising a plurality of LED components, an LED driver, a PWM controller, a dimming circuit unit, and a dimming switch, and able to regulate response of the LED driver according to the variation of a dimming signal generated by the dimming circuit unit. The feed circuit comprises:

an error amplifier unit, being electrically connected to output ends of the LED driver through at least one signal detection unit, used for generating a feedback signal based on an output signal of the LED driver;

an optical coupler, being electrically connected to the error amplifier unit, used for transmitting the feedback signal to the PWM controller; and a bandwidth regulating unit, being electrically connected between the optical coupler and the PWM controller, and also electrically connected to the dimming circuit unit;

wherein the bandwidth regulating unit is configured to produce an electrical resistance for regulating the feedback signal outputted from the error amplifier unit according to the dimming signal of the dimming circuit unit; moreover, the regulated feedback signal being further transmitted to the PWM controller, so as to make the PWM controller correspondingly generate a controlling signal to adaptively regulate bandwidth of the LED driver.

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE PREFERRED EMBODIMENTS

To more clearly describe a feedback circuit capable of regulating response according to variation of dimming signal according to the present invention, embodiments of the present invention will be described in detail with reference to the attached drawings hereinafter.

First Embodiment

Figure 3:
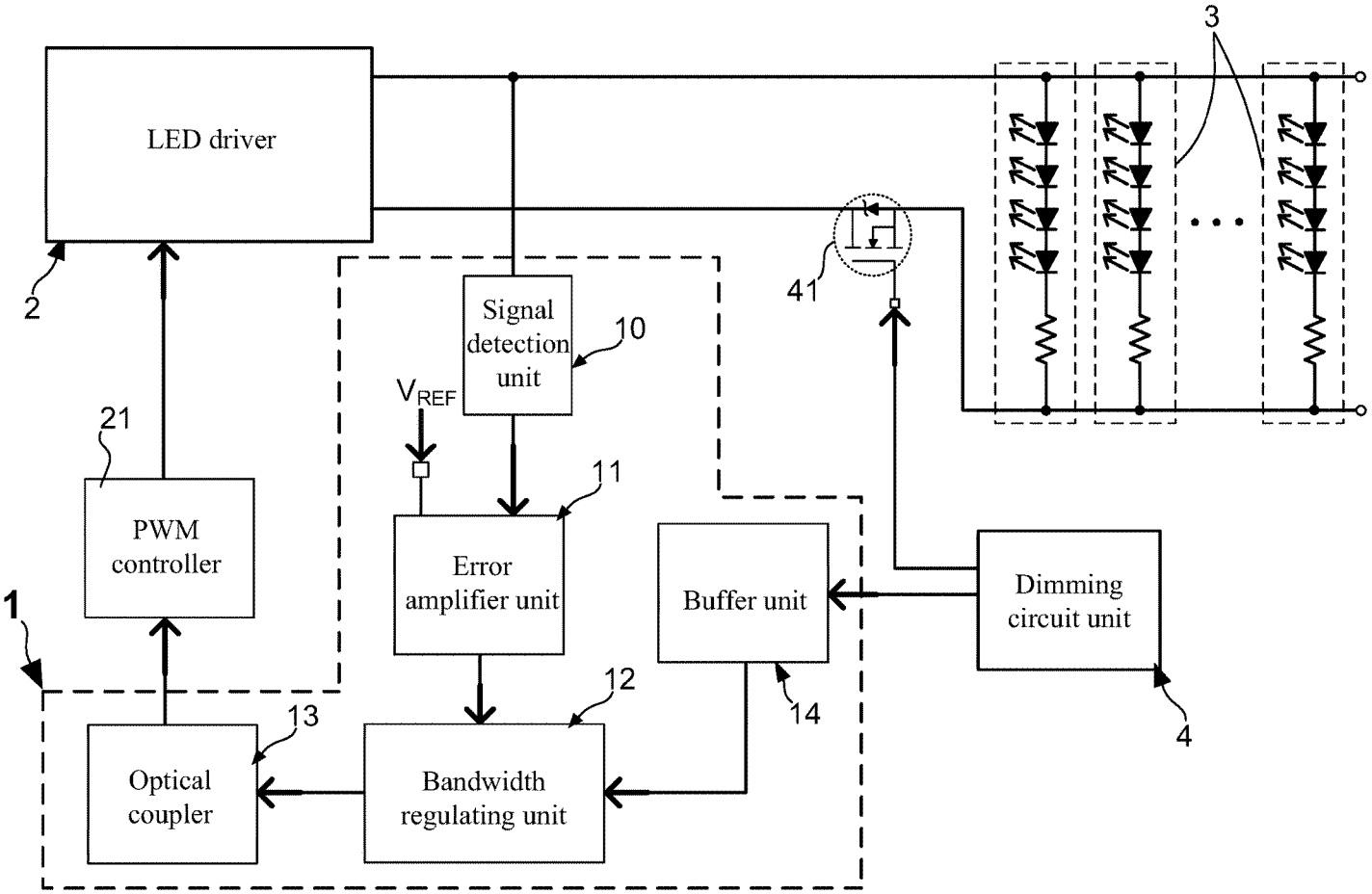
FIG. 3 shows a circuit block diagram of a first embodiment of a feedback circuit capable of regulating response according to variation of dimming signal.
Figure 4:
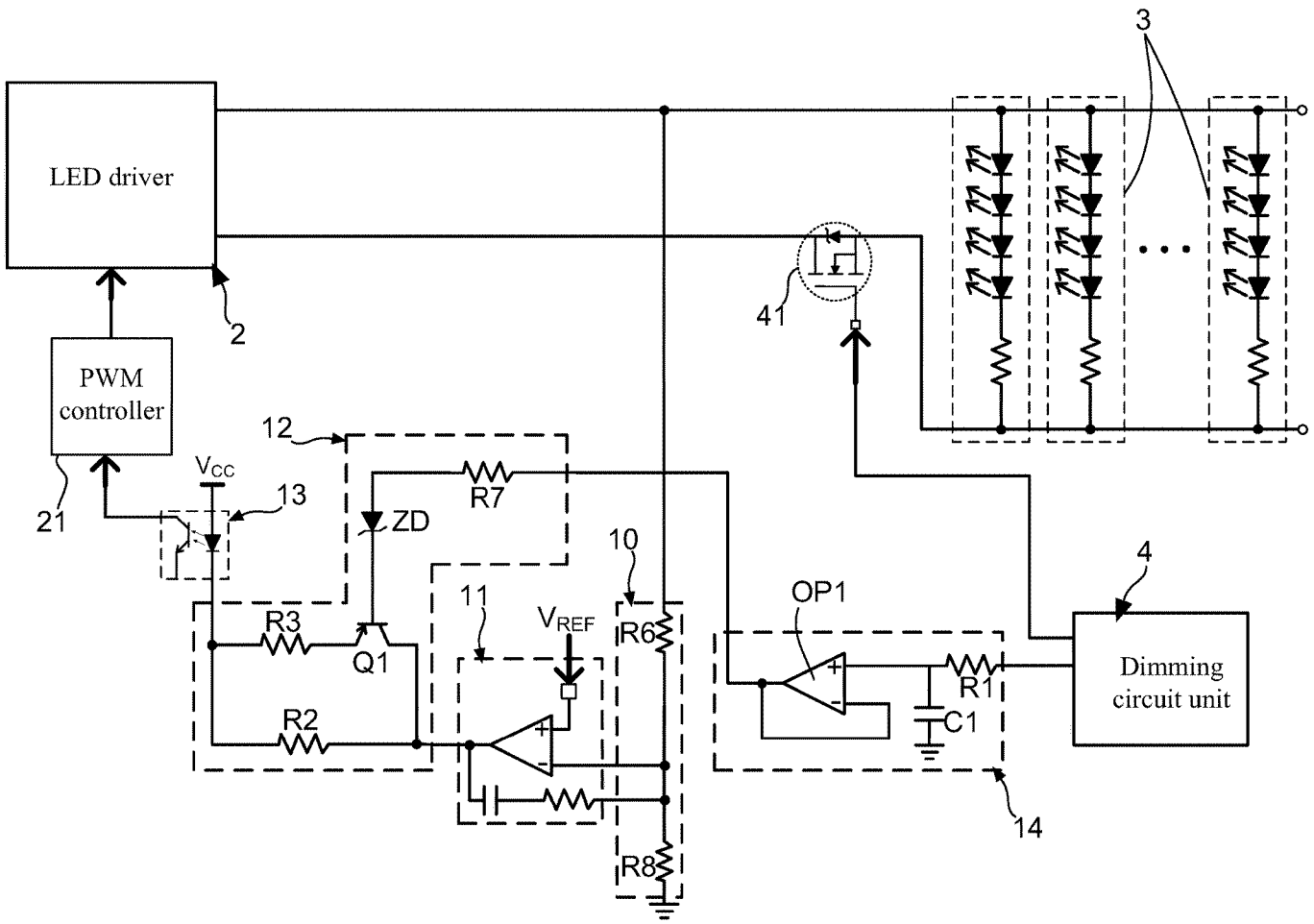
FIG. 4 shows a circuit framework diagram of the first embodiment of the feedback circuit.

With reference to FIG. 3, there is provided a circuit block diagram of a first embodiment of a feedback circuit capable of regulating response according to variation of dimming signal. As FIG. 3 shows, the feedback circuit 1 is applied in an LED illumination apparatus comprising a plurality of LED components, an LED driver 2, a PWM controller 21, a dimming circuit unit 4, and a dimming switch 41. Moreover, it is also found that the multi LED components are connected to each other in serial connection to form a plurality of LED strips 3, wherein the LED strips 3 are further connected to each other in parallel connection and act as a load of an LED driver 2. Please simultaneously refer to FIG. 4, which illustrates a circuit framework diagram of the first embodiment of the feedback circuit. As FIG. 3 and FIG. 4 show, the feed circuit 1 of the present invention mainly compresses: an error amplifier unit 11, a bandwidth regulating unit 12 and an optical coupler 13, wherein the error amplifier unit 11 is electrically connected to output ends of the LED driver 2 through at least one signal detection unit 10, and used for generating a feedback signal based on an output signal of the LED driver 2 and a reference signal $V_{REF}$. It is worth explaining that, energy outputted to the LED strips 3 comprising output signals at least including output voltage signal. Moreover, the error amplifier unit 11 receives the output signals through the signal detection unit 10. In the present invention, the signal detection unit 10 is a voltage divider comprising a first voltage dividing resistor R6 and a second voltage dividing resistor R8. On the other hand, the error amplifier unit 11 comprises a voltage-mode error amplifier, and an output resistor R2 is connected to the output end of the voltage-mode error amplifier.

It is worth explaining that, in spite of the fact that FIG. 3 indicates that the connection type of the LED components is serial-parallel connection type, that is not used for limiting the connection type of the LED components. In any other practical applications, the connection type of the LED components can also be parallel-serial connection type. In addition, the feedback circuit 1 further comprises a buffer unit 14, which is electrically connected between the bandwidth regulating unit 12 and the dimming circuit unit 4, and comprises an input resistor R1, an input filter capacitor C1 and a voltage follower amplifier OP1. On the other hand, the bandwidth regulating unit 12 is electrically connected to the error amplifier unit 11 and the dimming circuit unit 4, and comprises: a base resistor R7, a BJT Q1, a zener diode ZD, and an emitter resistor R3, wherein the base resistor R7 is connected to the buffer unit 14 by one end thereof. Moreover, the BJT Q1 is connected the other end of the base resistor R7, the optical coupler 13 and the error amplifier 11 by base terminal, emitter terminal and collector terminal thereof. As FIG. 4 shows, the zener diode ZD is electrically connected between the base terminal of the BJT Q1 and the base resistor R7, and the emitter resistor R3 is electrically connected between the emitter terminal of the BJT Q1 and the optical coupler 13. Besides, the output resistor R2 is electrically connected between the collector terminal and the emitter terminal of the BJT Q1.

By such circuit arrangement for the feedback circuit 1, the bandwidth regulating unit 12 would produce an electrical resistance for regulating the feedback signal outputted from the error amplifier unit 11 according to the dimming signal of the dimming circuit unit 4 during the normal operation of the LED driver 2 and the dimming circuit unit 4. Therefore, the regulated feedback signal would be further outputted by the optical coupler 13 for making the PWM controller 21 correspondingly generate a controlling signal to adaptively regulate bandwidth of the LED driver 2.

Figure 1:
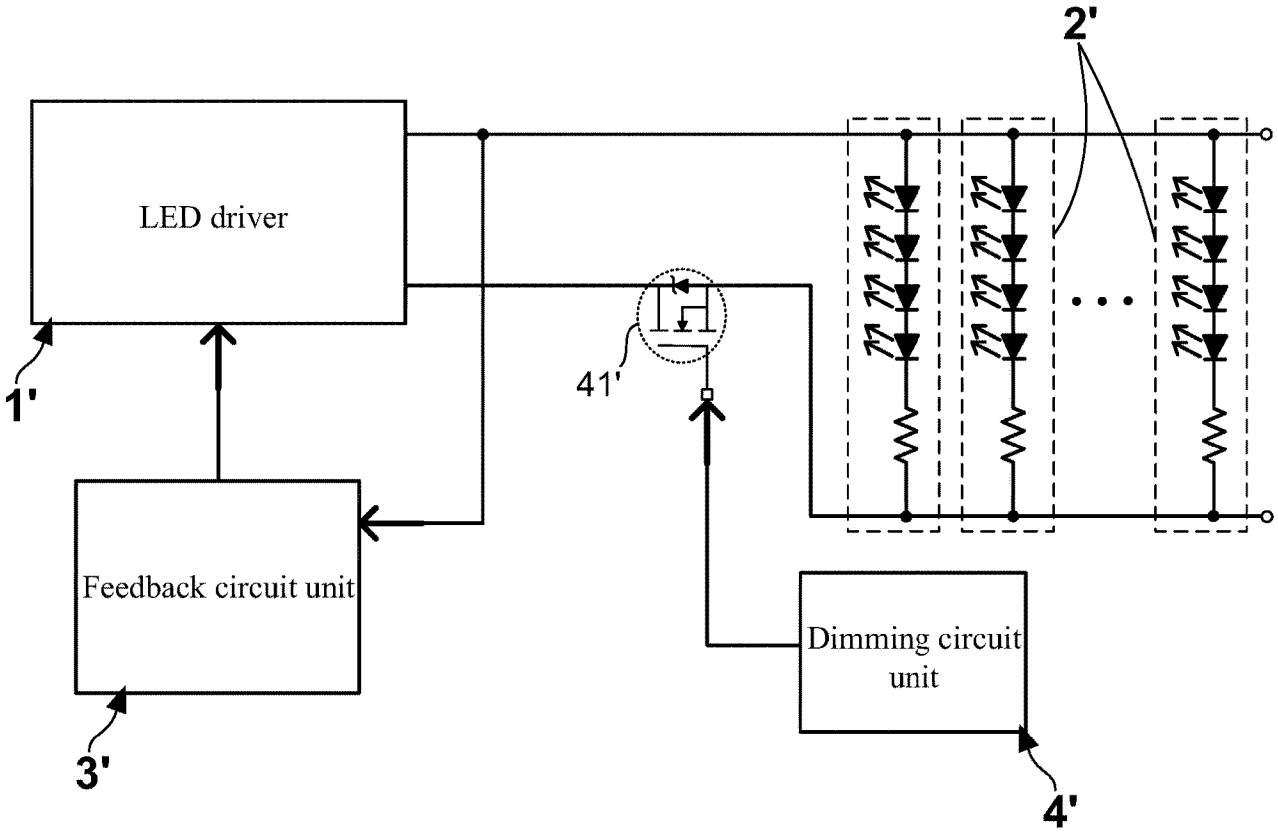
FIG. 1 (Prior Art)
FIG. 1 shows a circuit framework diagram of a conventional LED illumination apparatus.
Figure 2:
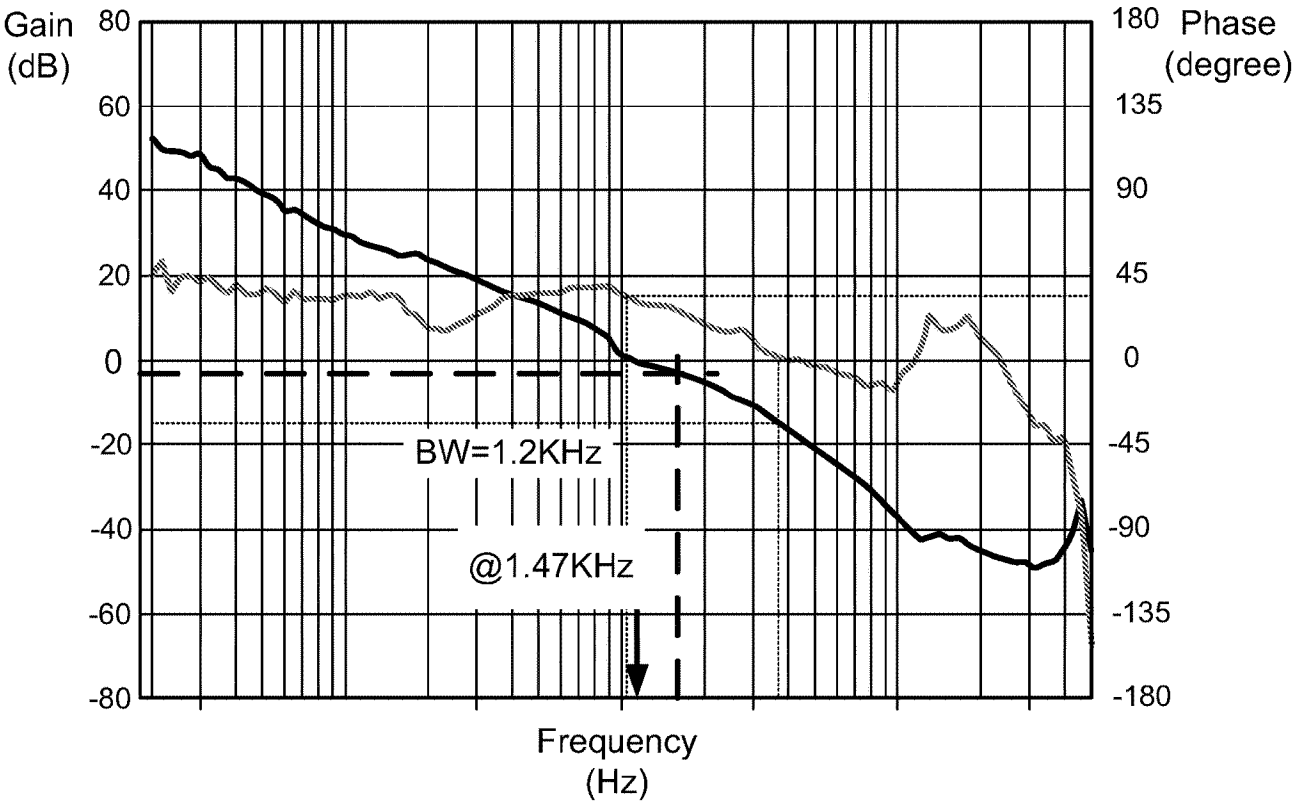
FIG. 2 shows a Bode plot for describing the response of an LED driver.
Figure 5:
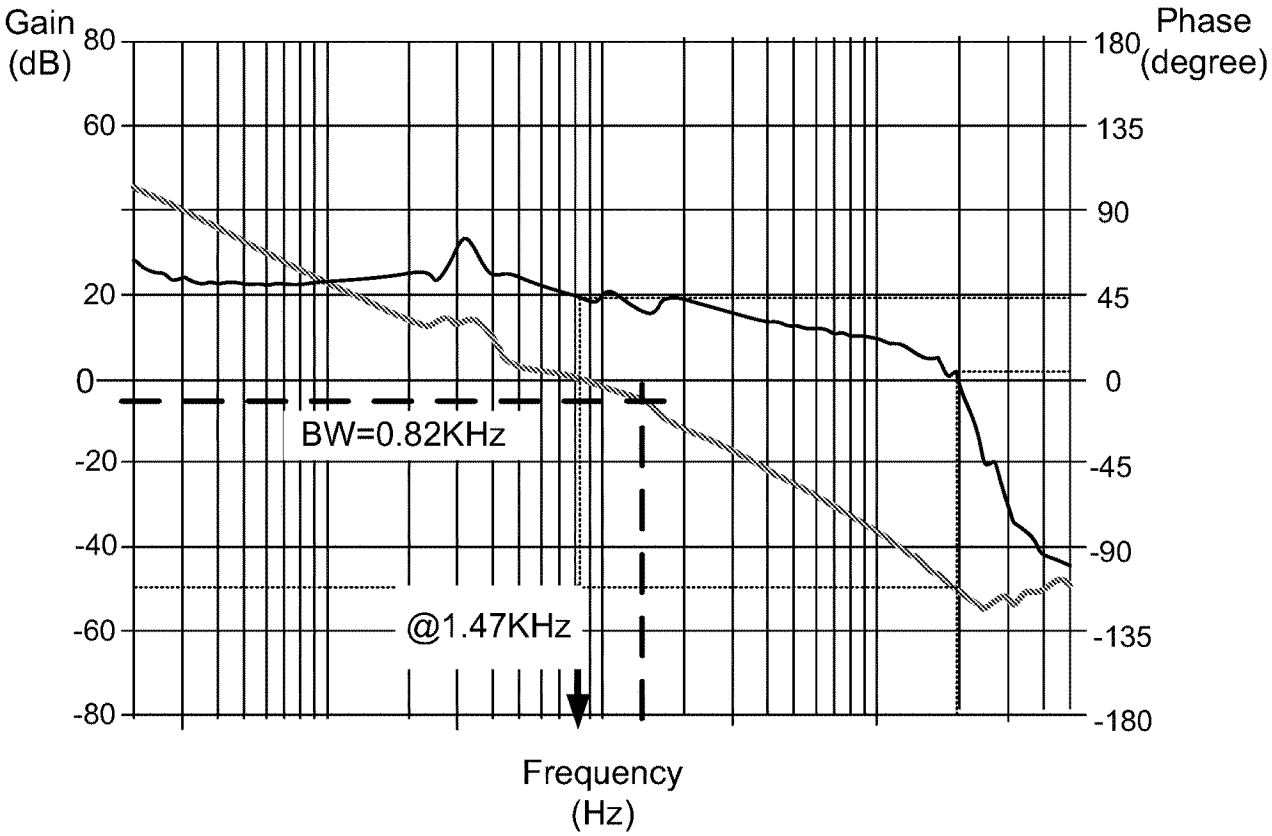
FIG. 5 shows a Bode plot for describing the response of an LED driver.

After comprising FIG. 1 with FIG. 3, electronic engineers skilled in development and manufacture of the LED driver 2 can easily find that, the feedback circuit 1 additionally includes a bandwidth regulating unit 12 and a buffer unit 14 in view of the conventional feedback circuit unit 3' shown in FIG. 3. Referring to FIG. 2 again, and please simultaneously refer to a Bode plot for describing the response of the LED driver 2 shown by FIG. 5. From FIG. 2 and FIG. 5, it is found that the bandwidth (BW) of the response of the LED driver 2 is reduced from 1.2 KHz to 0.82 KHz after a dynamic compensation is applied to the output voltage of the LED driver 2 by the feedback circuit 1. In addition, it is worth noting that, the frequency response of the LED driver 2 exhibits −8 dB gain at 1.47 KHz, and that means this novel feedback circuit 1 can indeed adaptively maintain the stability of the response of the LED driver 2 based on the variations of the output voltage of the LED driver 2 as well as the dimming signal. More particularly, the feedback circuit can attenuate audible noise of produced by the LED driver 2 due to the instability of the response through regulating bandwidth, gain margin and phase margin of the response of the LED driver 2.

Second Embodiment

Figure 6:
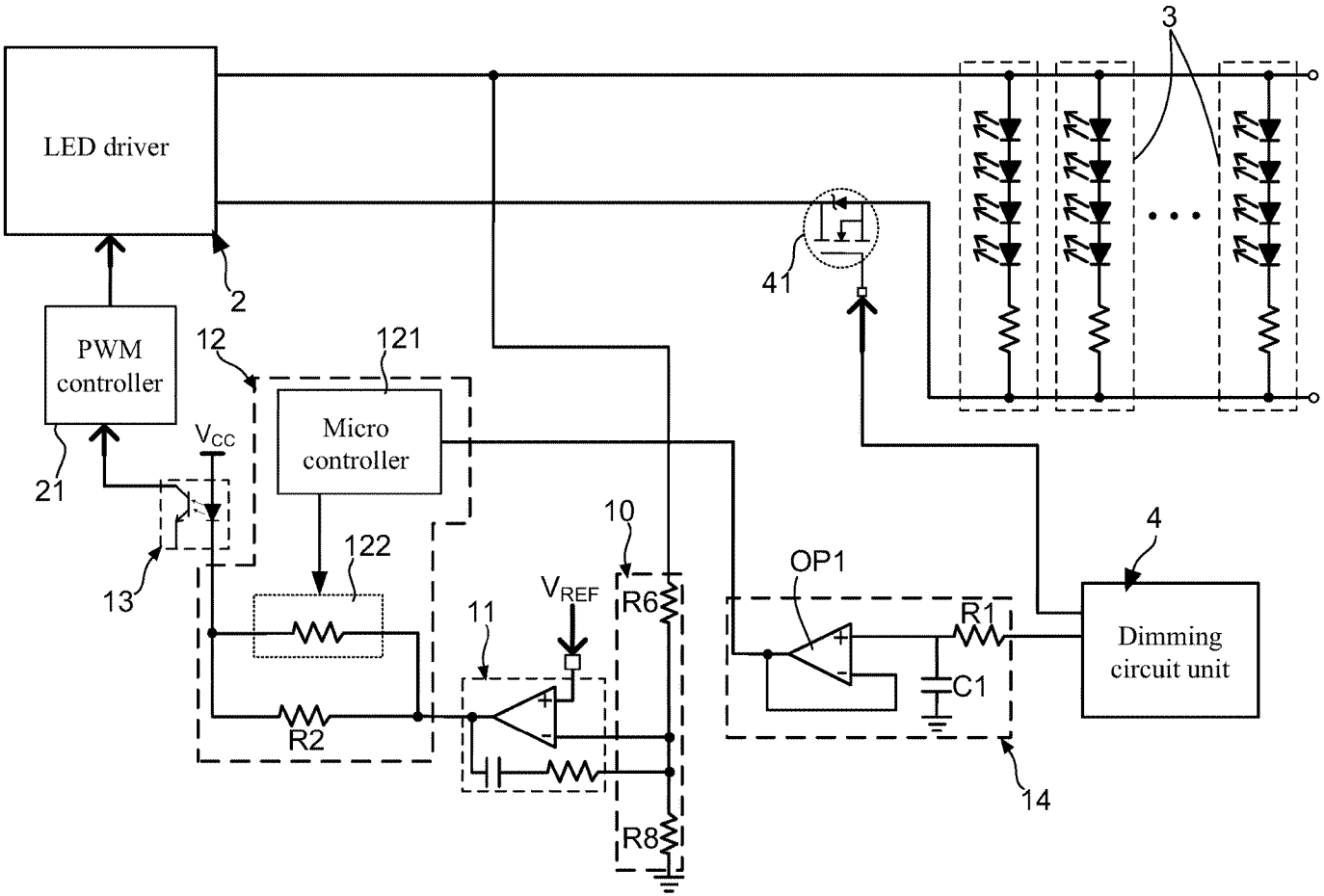
FIG. 6 shows a circuit framework diagram of a second embodiment of the feedback circuit.
Figure 7:
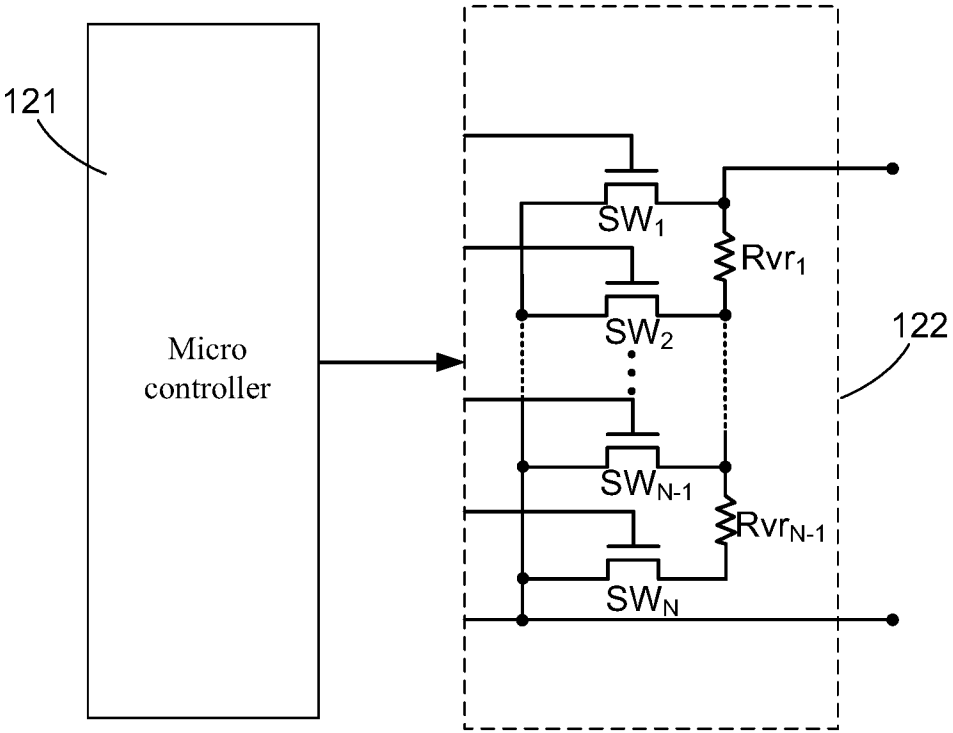
FIG. 7 shows a circuit framework diagram of a bandwidth regulating unit.

FIG. 6 shows a circuit framework diagram of a second embodiment of the feedback circuit. After comparing FIG. 4 with FIG. 6, it is able to know that, the second embodiment uses a potentiometer (POT) comprising a micro controller 121 and a potential module 122 as the said bandwidth regulating unit 12. As FIG. 6 shows, the micro controller 121 is electrically connected to the buffer unit 14, and the potential module 122 is electrically connected to the micro controller 121 and parallel to the output resistor R2. Please simultaneously refer to FIG. 7, which illustrates a circuit framework diagram of a bandwidth regulating unit. As FIG. 7 shows, the potential module 122 comprises a plurality of MOSFETs ($SW_1$, $SW_2$, . . . , $SW_N$) and a plurality of potential regulating resistors ($Rvr_1$, $Rvr_2$, . . . , $Rvr_{N-1}$), wherein all the MOSFETs are electrically connected to the micro controller 121 for being used as digital switched. Moreover, the MOSFETs are electrically connected to each other in parallel, and any one of the potential regulating resistors is electrically connected between two MOSFETs. From FIG. 7, it is also understood that the potential module 122 have two output ports, wherein one output port is electrically connected to the output end of the error amplifier unit 11, and the other output port is electrically connected to the optical coupler 13.

Third Embodiment

Figure 8:
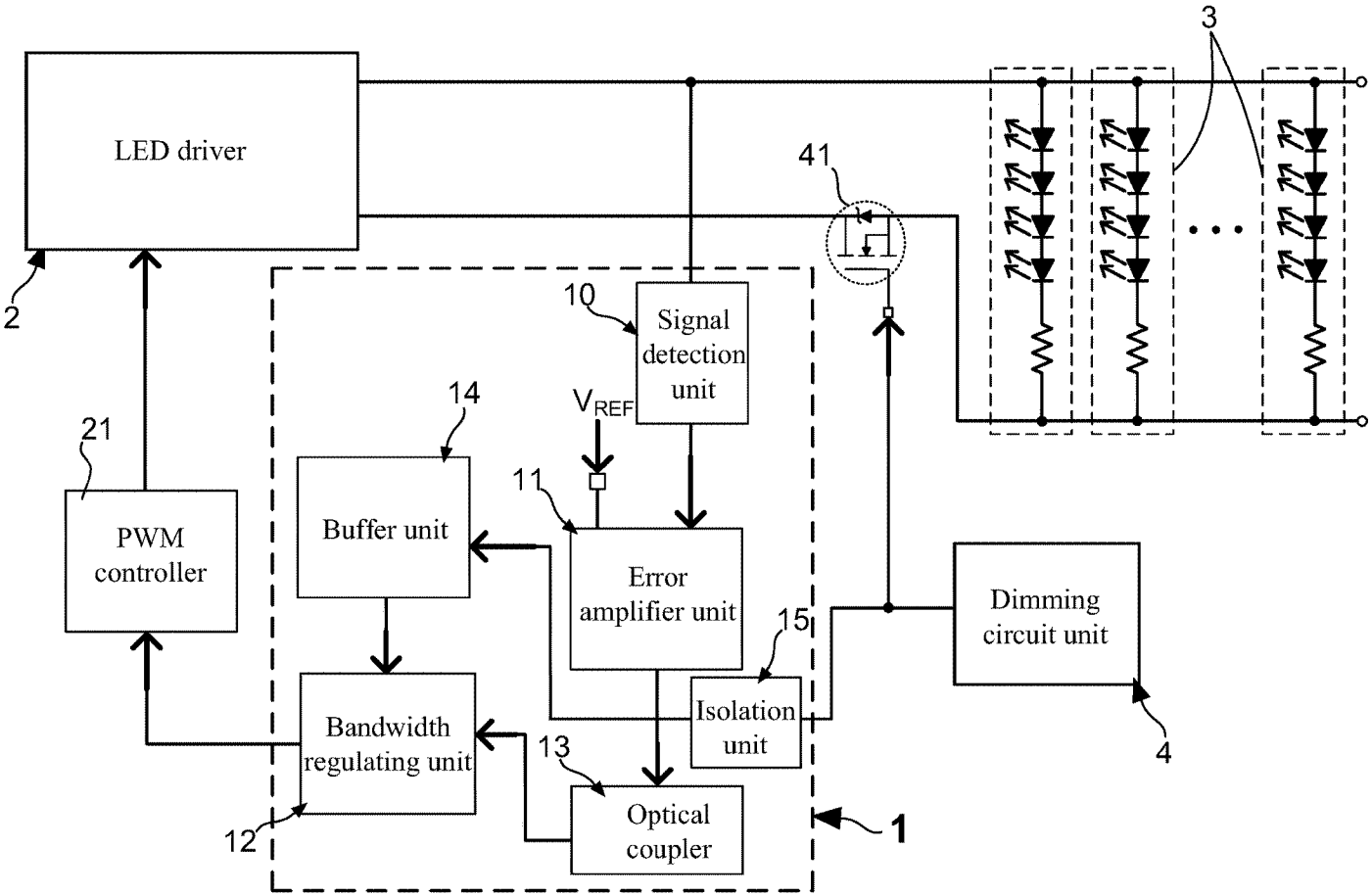
FIG. 8 shows a circuit block diagram of a third embodiment of the feedback circuit.
Figure 9:
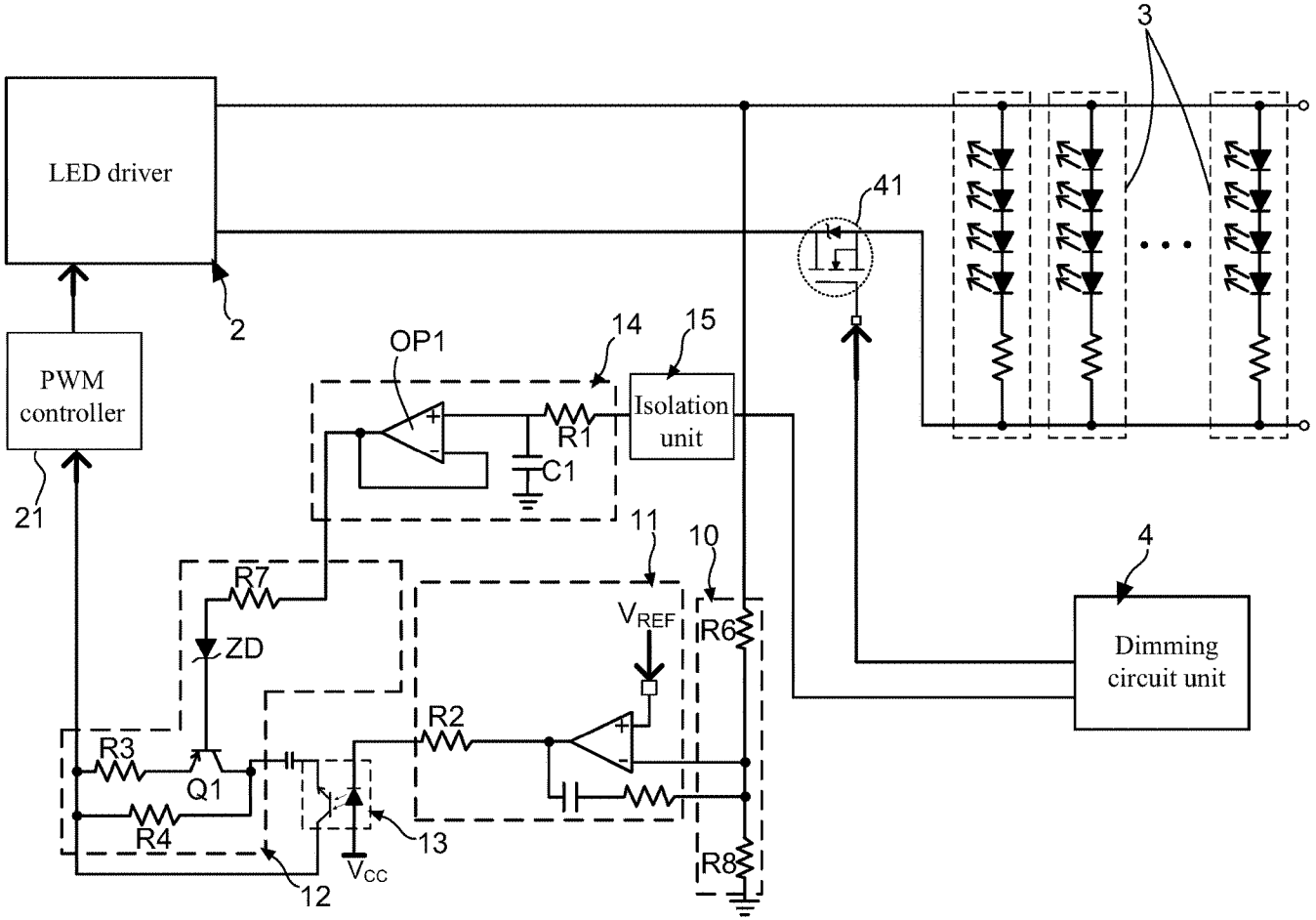
FIG. 9 shows a circuit framework diagram of the third embodiment of the feedback circuit.

FIG. 8 shows a circuit block diagram of a third embodiment of the feedback circuit. After comparing FIG. 3 with FIG. 8, it can easily find that the difference between the third embodiment and the first embodiment is the arrangement and disposing way of the bandwidth regulating unit 12. Please simultaneously refer to FIG. 9, which illustrates a circuit framework diagram of the third embodiment of the feedback circuit. In third embodiment, the optical coupler 13 is directly connected to the error amplifier unit 11, and the bandwidth regulating unit 23 is electrically connected between the optical coupler 13 and the PWM controller 21. As FIG. 9 shows, the bandwidth regulating unit 12 comprises a base resistor R7, a BJT Q1, a zener diode ZD, and an emitter resistor R3, wherein base resistor R7 is connected to the buffer unit 14 by one end thereof. Moreover, the BJT Q1 is connected the other end of the base resistor R7, the PWM controller 21 and the optical coupler 13 by base terminal, emitter terminal and collector terminal thereof. On the other hand, the zener diode ZD is electrically connected between the base terminal of the BJT Q1 and the base resistor R7, and the emitter resistor R3 is electrically connected between the emitter terminal of the BJT Q1 and the PWM controller 21. In addition, there is a capacitor (not shown) connected between the optical coupler 13 and the bandwidth regulating unit 12. Moreover, considering to the fact that the primary-side ground is different from the secondary-side ground in the LED driver 2, it is able to further add an isolation unit 15 connected between the buffer unit 14 and the dimming circuit unit 4.

Fourth Embodiment

Figure 10:
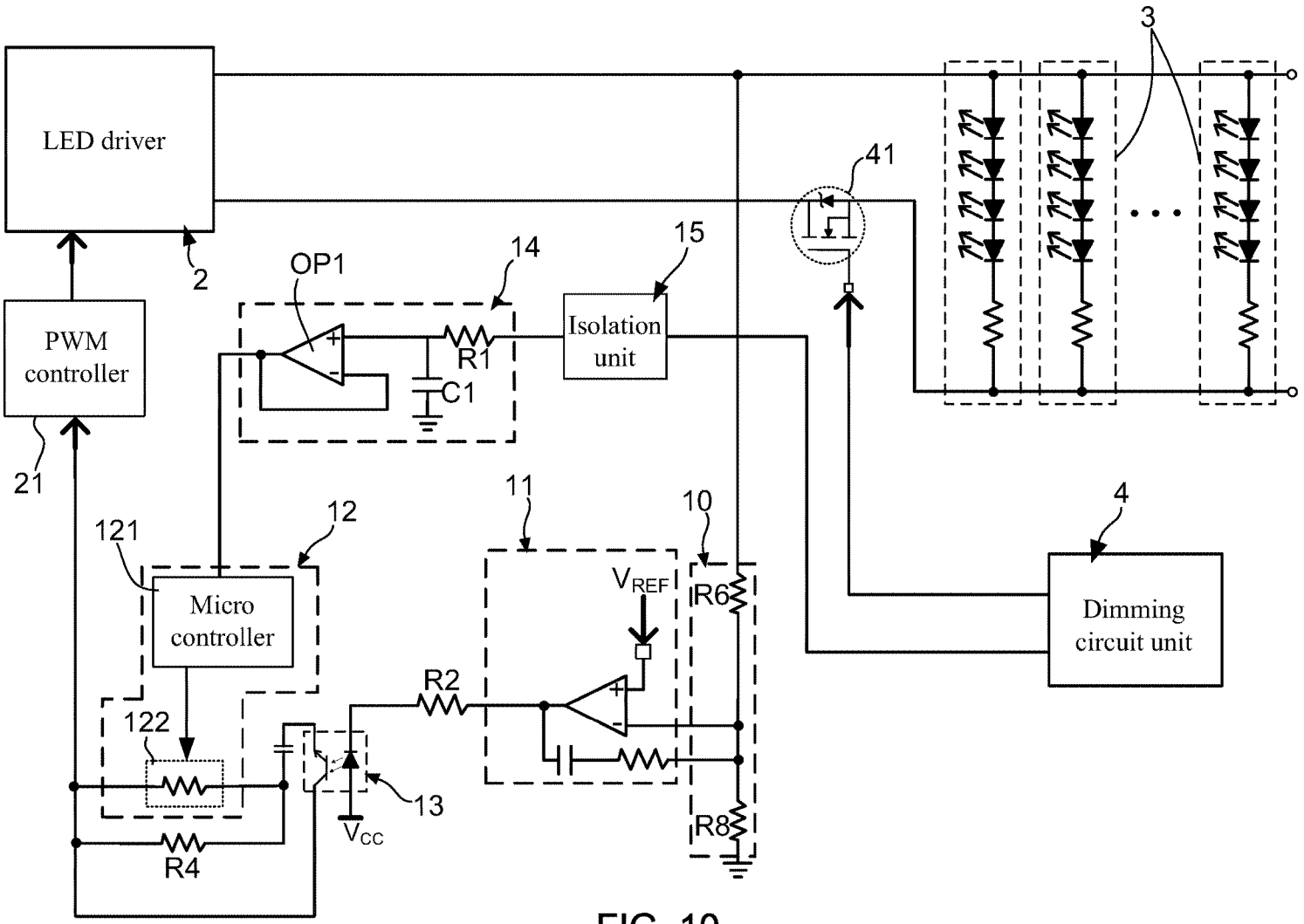
FIG. 10 shows a circuit framework diagram of a fourth embodiment of the feedback circuit.

FIG. 10 shows a circuit framework diagram of a fourth embodiment of the feedback circuit. After comparing FIG. 9 with FIG. 10, it is able to know that, the fourth embodiment uses a potentiometer (POT) comprising a micro controller 121 and a potential module 122 as the said bandwidth regulating unit 12. As FIG. 10 shows, the micro controller 121 is electrically connected to the buffer unit 14; moreover, the potential module 122 is electrically connected to the micro controller 121, and also electrically connected between the optical coupler 13 and the PWM controller 21. From FIG. 10, it is also found that the output resistor R2 is arranged in secondary side of the LED driver 2 and a resistor R4 is connected to the potential module 122 in parallel, wherein these two resistors can be used for regulating the feedback response. Moreover, the same as the third embodiment, an isolation unit 15 is also adopted for separating the primary side and the secondary side of the LED driver 2 in the fourth embodiment.

Therefore, through above descriptions, the feedback circuit capable of regulating response according to variation of dimming signal have been introduced completely and clearly; in summary, the present invention includes the advantages of:

(1) As FIG. 1 shows, conventional LED illumination apparatus commonly constituted by a plurality of LED strips 2', an LED driver 1', a feedback circuit unit 3' and a dimming circuit unit 4'. However, the dimming circuit unit 4' is found to increase the difficulty and complexity of keeping the response of the LED driver 1' for the feedback circuit unit 3' according to dynamic load variations. In view of that, the present invention particularly discloses a feedback circuit 1 capable of regulating response according to variation of dimming signal, which is implemented in an LED illumination apparatus, and comprises an error amplifier unit 11, a bandwidth regulating unit 12 and an optical coupler 13. When an LED driver 2 and a dimming circuit unit 4 of the LED illumination apparatus normally work, the bandwidth regulating unit 12 produces an electrical resistance for regulating a feedback signal provided by the error amplifier unit 11 based on a dimming signal of the dimming circuit unit 4. Therefore, the regulated feedback signal is subsequently outputted by the optical coupler 13 for making a PWM controller 21 correspondingly generate a controlling signal to adaptively regulate bandwidth of the LED driver 2.

(2) Inheriting to above descriptions, moreover, this feedback circuit 1 can also adaptively maintain the stability of the response of the LED driver 2 based on the variations of the output voltage of the LED driver 2 as well as the dimming signal. More particularly, the feedback circuit 1 is able to attenuate audible noise of produced by the LED driver 2 due to the instability of the response through regulating bandwidth, gain margin and phase margin of the response of the LED driver 2.

The above description is made on embodiments of the present invention. However, the embodiments are not intended to limit scope of the present invention, and all equivalent implementations or alterations within the spirit of the present invention still fall within the scope of the present invention.

What is claimed is:

1. A feedback circuit for use in an LED illumination apparatus comprising a plurality of LED components, an LED driver, a PWM controller, a dimming circuit unit, and a dimming switch, being capable of regulating response of the LED driver according to the variation of a dimming signal generated by the dimming circuit unit, and comprising:

an error amplifier unit, being connected to output ends of the LED driver through at least one signal detection unit, used for generating a feedback signal based on an output signal of the LED driver; and a bandwidth regulating unit, being connected to the error amplifier unit and the dimming circuit unit;

wherein the bandwidth regulating unit is configured to produce an electrical resistance for regulating the feedback signal according to the dimming signal; moreover, the regulated feedback signal carrying out a bandwidth regulation of the LED driver.

2. The feedback circuit of claim 1, further comprising:

a buffer unit, being connected between the bandwidth regulating unit and the dimming circuit unit, and comprising an input resistor, an input filter capacitor and a voltage follower amplifier; and an optical coupler, being connected between the bandwidth regulating unit and the PWM controller.

3. The feedback circuit of claim 1, wherein the signal detection unit comprises a first voltage dividing resistor and a second voltage dividing resistor, and the error amplifier unit comprises a voltage-mode error amplifier.

4. The feedback circuit of claim 3, wherein an output resistor is connected to the output end of the voltage-mode error amplifier.

5. The feedback circuit of claim 2, wherein the bandwidth regulating unit comprises:

a base resistor, being connected to the buffer unit by one end thereof;

a BJT, being connected the other end of the base resistor, the optical coupler and the error amplifier by base terminal, emitter terminal and collector terminal thereof;

a zener diode, being connected between the base terminal of the BJT and the base resistor; and an emitter resistor, being connected between the emitter terminal of the BJT and the optical coupler;

wherein the output resistor is connected between the collector terminal and the emitter terminal of the BJT.

6. The feedback circuit of claim 2, wherein the bandwidth regulating unit comprises:

a micro controller, being connected to the buffer unit; and a potential module, being connected to the micro controller and parallel to the output resistor.

7. The feedback circuit of claim 6, wherein the potential module comprises:

a plurality of switches, wherein all the switches are connected to the micro controller, and the switches are connected to each other in parallel; and a plurality of potential regulating resistors, wherein any one of the potential regulating resistors is connected to two switches.

8. The feedback circuit of claim 1, further comprising:

a buffer unit, being connected between the bandwidth regulating unit and the dimming circuit unit, and comprising an input resistor, an input filter capacitor and a voltage follower amplifier; and an optical coupler, being connected between the bandwidth regulating unit and the error amplifier unit.

9. The feedback circuit of claim 8, wherein there is a capacitor connected between the optical coupler and the bandwidth regulating unit.

10. The feedback circuit of claim 8, wherein there is an isolation unit connected between the buffer unit and the dimming circuit unit.

* * * * *